United States Patent [19]

Gierek et al.

[11] 4,070,210

[45] Jan. 24, 1978

[54] METHOD FOR HOT AND IMMERSION ALUMISING OF COMPACTLY FORMED FERROUS ALLOY PRODUCTS

[75] Inventors: Adam Gierek; Lech Bajka, both of Katowice, Poland

[73] Assignee: Politechnika Slaska Im. Wincentego Pstrowskiego, Gliwice, Poland

[21] Appl. No.: 649,158

[22] Filed: Jan. 14, 1976

[30] Foreign Application Priority Data

Jan. 18, 1975 Poland ..... 177421

[51] Int. Cl.[2] ..... C21D 1/48

[52] U.S. Cl. ..... 148/15; 148/20; 148/142; 427/329

[58] Field of Search ..... 148/15, 20, 155; 427/320, 329

[56] References Cited

U.S. PATENT DOCUMENTS

| | | | |
|---|---|---|---|
| 1,879,701 | 9/1932 | Marino | 148/15 |
| 2,166,510 | 7/1939 | Whitfield et al. | 427/320 |
| 2,174,645 | 10/1939 | Wetzel | 148/20 |
| 2,396,730 | 3/1946 | Whitfield et al. | 148/15 |
| 2,569,097 | 9/1951 | Grange et al. | 148/15 |
| 2,797,177 | 6/1957 | Keller | 148/15 |
| 3,027,269 | 3/1962 | Teshima et al. | 427/320 |

FOREIGN PATENT DOCUMENTS

| | | | |
|---|---|---|---|
| 1,011,972 | 12/1965 | United Kingdom | 148/15 |

*Primary Examiner*—Walter R. Satterfield
*Attorney, Agent, or Firm*—Haseltine, Lake & Waters

[57] ABSTRACT

A process for simultaneously heat treating and aluminizing ferrous alloy products comprising pre-heating and immersing such products in a molten aluminum metal bath for a necessary period to both heat treat and aluminize, followed by a vibratory removal of any excess molten aluminum metal on said products.

7 Claims, No Drawings

METHOD FOR HOT AND IMMERSION ALUMISING OF COMPACTLY FORMED FERROUS ALLOY PRODUCTS

This invention relates to a method for hot immersion aluminizing of ferrous alloy products, such as malleable iron castings, spheroidal iron castings, grey iron castings and steel castings or products. These castings or products may or may not have been previously machined and are designed for use under conditions inducing intense corrosion at high temperatures.

More particularly this invention relates to a method for simultaneously heat treating and aluminizing compactly formed ferrous alloy products, wherein an aluminum or an aluminum alloy coating is formed on the surface of such product workpieces, followed by a preheating to a temperature of 100° to 400° C and then subjecting such work-pieces to a 15 seconds to 30 minutes heat treatment in a molten metal bath of liquid aluminum or of its alloys at a temperature of 550° to 950° C.

The presently employed processes for producing heat treated and compactly formed ferrous alloy products designed for use under conditions inducing intense corrosion at high temperatures, consists of a series of separate operations, such as casting or plastic working by means of which the work-piece is given a distinct shape and dimension; a heat treatment by which the work-piece is provided with improved mechanical properties; and coating or plating of the work-piece so as to provide an anticorrosive preservative coating. The heat treatment includes relief annealing, recrystallizing, coagulation annealing, also called soft annealing, normalizing, quenching, isothermal quenching and toughening.

One of the most universally utilized methods for providing anticorrosive protection in the mass production of ferrous alloy products is hot metallization, e.g. hot immersion tinning, hot immersion galvanizing or aluminizing. Machining, abrading or filing of a product enables formation of the final shape or dimension. For instance, threading, in most cases is done after the work-piece has been coated with an anticorrosive coating. Heat treatment processes, on the other hand, are conducted before the protective coating is applied, or before other processes are employed to protect the surface of the work-piece against corrosion.

One of the known processes employed for the production of screws and bolts of steel containing 0.32–0.4% of C, then heat treated in order to improve the mechanical properties, includes also a hot immersion galvanizing of previously heat treated products to protect against surface corrosion. After machining, e.g. threading, the screws or bolts are normalized by heating them up to a temperature of about 850° C and then annealing at this temperature for a period of time no longer than an hour. This is then followed by slow air cooling. The heat treatment process takes place in a radiation furnace with an inert atmosphere. After normalization is completed and after suitably preparing the product surfaces, it is immersed in a zinc or a zinc alloy bath.

There are many inherent undesirable features with the known methods employed in heat treatment processes making compactly formed ferrous alloy products designed for operation under conditions inducing intensive corrosion, at high temperatures. The heat treatment processes for such products, including relief annealing, recrystallizing, coagulation annealing also called soft annealing, normalizing, quenching or isothermal quenching, and toughening, are carried out separately from the processes used for the production of product surfaces against corrosion or the effect of high temperatures. These latter processes include, for instance, hot and immersion galvanizing or aluminizing, and require considerable amounts of extra energy. These processes are, as a rule, processes which require a long time, because of the time needed for the heat-up of conventional radiation furnaces having a gas atmosphere. The heat treatment processes require use of protective atmospheres, thus adding to the overall costs, since furnaces of a special construction, as well as a protective atmosphere have to be used. But while annealing in a normal atmosphere is cheaper, it causes a series of undesirable changes in the surface layer of heat treated work-pieces because of oxidation. In all cases of gas annealing irrespective of the character of such gas annealing, undesirable surface processes occur in the product to a greater or lesser degree. These processes include adsorption of gas molecules and resorption of some of the constituents of ferrous alloys, this being manifested, among others, by oxidation or decarbonization of the surface, namely effects that tend to have an adverse influence on the mechanical properties of these alloys. The time which is required for heating when treating in gases causes excessive growth of grain size, which also affects negatively these properties.

The purpose of this invention is to obviate or mitigate the problems inherent in the presently known methods employed in the production of compactly formed, heat treated ferrous alloy products designed for operation under conditions inducing intense corrosion at high temperatures.

This purpose is achieved by coating the surfaces of compactly formed, non-heat treated ferrous alloy products, irrespective of the complexity of their shape, with a layer of aluminum, and then simultaneously subjecting said products to heat treatment by a hot immersion aluminizing process. This heat treatment includes the processes of relief annealing, recrystallizing, coagulation annealing, also called soft annealing, normalizing, quenching or isothermal quenching and toughening, respectively. These products can be subjected, whether finally machined, abraded and filed or not, to the simultaneous process of producing an aluminum diffusion layer and to heat treatment.

The aluminum alloy may be those with a metal such as Li, Na, Si, Pb, Cu, Sn, Zn, Cr, Ni, Fe, Cd, Mg, Bi, Be, Ag, Ca, Co, In, Mn, Mo, Sb, Se, Te, Zr, Ti.

The simultaneous heat treatment and aluminum or aluminum alloy coating of the products in a molten aluminum or aluminum alloy bath is conducted for 15 seconds to 30 minutes at a temperature of 550° to 950° C. This is accomplished by immersing the products in said bath in a continuous or step-wise fashion at a rate of from 0.21 to 12 m/min. Products that are to be so treated may be preheated to a temperature of 100° to 400° C. Excess aluminum or aluminum alloy is removed from the surfaces of such aluminized products by vibrating at a suitable speed rate. For instance at a frequency rate ranging from 0.1 to 40,000 cycles/sec. The vibration or shaking-off operation is carried out either at the same time when the products are removed from the bath, or immediately after removal, thus continuing the vibration above the bath level.

The formation of an aluminum diffusion layer on the surface of a compactly formed ferrous alloy product with simultaneous heat treatment of the same improves in addition to the anticorrosive and temperature resistance of these products, their mechanical properties as well. This improvement results from structural transformations taking place due to a suitable selection of process parameters, such as the temperature of the aluminum or aluminum alloy bath, the time of immersion, the rate of immersion and removal from the bath, as well as the cooling rate of aluminized products removed from said bath. An unquestionable improvement is thus gained as compared with conventional heat treatment in gases in that there is a considerable time reduction in the heat-up needed for a few minutes, as well as the elimination of a need for a protective atmosphere, without negatively affecting the structure of the surface layer, thus eliminating expensive and complex annealing furnaces. A heat treatment operation carried out in an aluminum bath eliminates oxidation and decarbonization problems on the surface of malleable cast iron products, these phenomena being a serious inherent drawback in the conventional heat treatment processes.

These improvements together with the negligibly growing size of the structural grains, resulting from the short heatup and subsequent heating in the aluminum or an aluminum alloy bath, are important factors in improving the mechanical properties of the products of this invention.

The Examples which follow hereinbelow dealing with the treatment of metal products is meant to be illustrative and is in no manner to be construed as limiting the invention.

EXAMPLE I

The surfaces of drilled and threaded metal sockets and flanges are cleaned and the work-pieces are preheated to a temperature of 200°- 300° C. They are then immersed while suspended from hangers at a continuous speed rate of from 3 to 12 m/min, in an aluminum bath at a temperature in the range of 740°- 800° C for 1 to 10 minutes. The work-pieces are then removed from the bath at a continuous speed rate of from 0.3 to 5 m/min and the excess liquid aluminum is removed by vibrating it off the work-pieces. This vibrating operation is started the moment the withdrawal of the products from the bath at a speed rate of 1 m/min begins, and is continued above the bath level at a frequency rate of from 300 to 500 cycles/sec with the amplitude determined by the mass and shape of the workpiece.

After the vibratory operation is completed, the aluminized castings are slowly cooled in the air. During the time the castings are kept in the bath of liquid aluminum as well as in the subsequent cooling, an aluminum diffusion layer is formed simultaneously with the coagulation of the eutectoid lamellar cementite this providing the treated socket and caps better mechanical properties, particularly better plasticity and higher anticorrosive resistance.

EXAMPLE II

The surfaces of threaded and unthreaded connectors are made of malleable white cast iron, where the wall structure as measured from the outer to the inner surface is, from a depth of about 1000 - 3000 μm, ferritic with eductions of temper carbon, then passing into a ferritic and perlite mixture with eductions of temper carbon, so that the mid-portion of the wall is exclusively perlite with temper carbon. This connector is cleaned, the links are preheated to a temperature within 150°-400° C and immersed, as contained in perforated baskets in a step-wise fashion at a speed rate of 2 to 6 m/min into an aluminum or an aluminum alloy bath at a temperature within 700°- 860° C. The connectors are kept in the bath for 30 seconds to 10 minutes and are then withdrawn from the bath at a step-wise controlled speed rate from 0.1 to 3 m/min. The excess liquid metal is removed by vibration in the same manner as in Example I. The connectors are then cooled in air. During the immersion step in the bath, as well as during cooling, a refinement and structural transformation in the matrix of the malleable white cast iron takes place thus obtaining a high-dispersion perlite inside the wall of the product. The end products have thus better mechanical properties and considerably higher anticorrosive resistance.

EXAMPLE III

The surfaces of thick-walled malleable black cast iron elements of agricultural machines are cleaned. The structure inside the walls of these elements is ferrite-perlitic. These castings are preheated to a temperature of 250°- 400° C and then immersed on hangers at a continuous speed rate of from 0.1 to 3 m/min into an aluminum or an aluminum alloy bath at a temperature from 700° to 900° C. The castings are kept in the bath for 1.5 to 10 minutes and are then removed from the bath at a continuous speed rate of again 0.1 to 3 m/min. The vibratory molten metal removal operation can be carried out in the same way as in Example I. The aluminized castings are then slowly cooled in the air. As the malleable black cast iron elements are kept in the bath, as well as during cooling, the dispersion of perlite inside the walls of the castings intensifies, thus improving the mechanical properties of aluminized products.

EXAMPLE IV

The surfaces of spheroidal cast iron elements, useful in internal combustion engines or in machine tools are cleaned. These cast iron elements have a perlitic or ferritic-perlitic matrix and are preheated to a temperature from 150° to 400° C. The elements are then immersed into a molten aluminum or aluminum alloy bath in a step-wise fashion at a speed rate of from 1 to 10 m/min, at a temperature ranging from 730° to 900° C. The castings are kept in the bath no longer than 30 minutes, and are removed therefrom at a speed rate ranging from 0.1 to 8 m/min, and subsequently cooled in air. While the elements are kept in the bath, as well as during cooling, an aluminum diffusion layer is formed on the surface, with simultaneous homogenization and refinement of the structure of the elements, this obtaining, inside the walls, a structure of high-dispersion perlite and spheroidal graphite, or of perlite with ferrite having eductions of spheroidal graphite. Elements so processed have better mechanical properties and higher anticorrosive resistance. A uniform distribution of aluminum is obtained over the surface of spheroidal perlitic and ferritic-perlitic cast iron castings by the vibratory removal of the excess molten aluminum or aluminum alloy even in complex shapes, such as threads. In said vibratory operation, the castings are suspended from hangers, with said vibration ranging from 300-500 cps started either at the moment their removal from the bath begins, or immediately after they have cleared the surface of said bath.

EXAMPLE V

The surfaces of spheroidal perlitic cast iron elements of machine tools are first cleaned, then preheated to a temperature of the order of 200°- 400° C and then immersed in a perforated basket at a speed rate of 4 to 10 m/min, into an aluminum or aluminum alloy bath at a temperature of the order of 800°- 900° C. After keeping said elements in a bath for no longer than 30 minutes, the castings are removed at a speed rate within 8 - 12 m/min, and after vibrating of the excess aluminum or aluminum alloy molten metal in a manner described in Example I, or immediately after removal from said bath, the castings are immersed in oil, in melted salts, or in a liquid metal bath at a temperature from 250° to 350° C. After removing them from such baths, the aluminized castings are cooled either in air or in water. Proceeding this way, an aluminum diffusion coating is obtained on the protecting surface and a bainitic structure of the matrix is formed across the whole section of the castings, thus providing improved mechanical properties for the spheroidal perlitic cast iron castings.

EXAMPLE VI

Grey cast iron valves used in petroleum pipelines have their surfaces cleaned and are then preheated to a temperature within 150° to 400° C. They are then immersed while contained in perforated baskets, at a stepwise speed rate of from 0.2 to 6 m/min, into an aluminum alloy bath at a temperature from 550° to 650° C. These valves are kept in the liquid metal bath for a time not longer than 30 minutes. While the elements are kept in the bath, as well as at the time of pre-cooling of the elements, a desirable pattern of internal stresses in the castings develops preventing any unexpected change in the shape or dimensions of the elements. The valves are removed from the liquid aluminum alloy bath in a stepwise fashion at a speed rate of from 0.1 to 5 m/min. A uniform distribution of the aluminum layer is obtained by shaking any excess aluminum off the elements as described in Example I.

EXAMPLE VII

Screw spikes made of steel having a ferritic-perlitic structure and containing 0.3 - 0.4% of C, are mechanically cleaned, etched and fluxed. The spikes are preheated to a temperature of 100°- 300° C, then immersed while suspended on hangers in a continuous fashion at a controlled speed rate from 2 to 8 m/min, into a molten aluminum bath at a temperature within the range of from 800° to 950°0 C. The screw spikes are kept in the bath for no longer than 4 minutes, and then, after removing them from the bath at continuous speed rate of 1 to 5 m/min, are slowly cooled in air. Upon removal from the bath, the excess liquid aluminum can be removed from the screw spikes by the vibratory technique described in Example I. While in the bath and during the subsequent air cooling a recrystallization and normalizing of ferritic-perlitic structure of steel takes place, thus causing an improvement in the mechanical properties of treated screw spikes and simultaneously obtaining an aluminum coating.

While this invention has been described with particular reference to specific practices and examples, it will be understood by those skilled in the art that it is susceptible to changes and modifications without departing from the scope thereof as defined in the appended claims.

What we claim is:

1. A method for heat treating and aluminizing compactly shaped ferrous alloy products comprising the steps of pre-heating said products to a temperature of 100° to 400° C., immersing the pre-heated products in a molten metal bath of liquid aluminum or an alloy of aluminum at a temperature of 550° to 950° C. for 15 seconds to 30 minutes at a controlled speed rate between 0.1 to 12 m/min, removing the products from said bath at a controlled speed rate between 0.1 to 12 m/min, and cooling the products in air or water.

2. The method of claim 1, further comprising the steps of immersing the products into the molten aluminum or aluminum alloy bath, and withdrawing it therefrom continuously.

3. The method of claim 1, further comprising the steps of immersing the products in the molten aluminum or aluminum alloy bath, and withdrawing it therefrom in a stepwise fashion.

4. The process of claim 1, further comprising the step of removing the excess molten liquid aluminum or its alloys from the surfaces of aluminized work-pieces by vibrating off the excess liquid metal from said products at a frequency of 0.1 to 40,000 cycles/sec.

5. The process of claim 4, further comprising the step of removing the work-piece from and through the surface of the molten metal bath, while vibrating off said excess liquid metal from said products.

6. The process of claim 4, further comprising the step of immediately vibrating off said excess liquid metal from said products upon the work-piece being withdrawn from, and clearing the surface of the metal bath.

7. The process of claim 1, wherein the molten metal bath comprises an alloy of aluminum with a metal selected from the group consisting of: Li, Na, Si, Pb, Cu, Sn, Zn, Cr, Ni, Fe, Cd, Mg, Bi, Be, Ag, Ca, Co, In, Mn, Mo, Sb, Se, Te, Zr, Ti.

* * * * *